US005089105A

United States Patent [19]

Tsutsui

[11] Patent Number: 5,089,105

[45] Date of Patent: Feb. 18, 1992

[54] COLOR-BEARING TEXTILE PRODUCT

[75] Inventor: Masatoshi Tsutsui, Aichi, Japan

[73] Assignee: Toyoda Gosei Co., Ltd., Nishikasugai, Japan

[21] Appl. No.: 525,649

[22] Filed: May 21, 1990

Related U.S. Application Data

[62] Division of Ser. No. 122,437, Nov. 19, 1987.

[30] Foreign Application Priority Data

Dec. 13, 1986 [JP] Japan ..... 61-297240

[51] Int. Cl.[5] ..... C23C 14/06; C23C 14/34

[52] U.S. Cl. ..... 204/192.14; 204/192.15; 204/192.26; 204/192.27

[58] Field of Search ..... 204/192.15, 192.26, 204/192.27, 192.14

[56] References Cited

U.S. PATENT DOCUMENTS 4,657,807 4/1987 Fuerstman ..... 428/263
4,816,124 3/1989 Manabe et al. ..... 204/492.15
4,927,683 5/1990 Tsutsui ..... 428/627

*Primary Examiner*—John Niebling
*Assistant Examiner*—Steven P. Marquis
*Attorney, Agent, or Firm*—Cushman, Darby & Cushman

[57] ABSTRACT

A color-bearing textile product which comprises fibers, a silver-gray metal layer formed on the surface of said fibers by sputtering, and a metal layer or metal compound layer of chromatic color formed on the surface of said metal layer by sputtering. The silver-gray metal layer is, for example, formed of titanium. The metal layer or metal compound layer of chromatic color is, for example, formed of gold, silver, copper, brass, or titanium nitride.

6 Claims, 2 Drawing Sheets

COLOR-BEARING TEXTILE PRODUCT

This is a division of application Ser. No. 07/122,437, filed Nov. 19, 1987.

BACKGROUND OF THE INVENTION

1. Field of the Invention

The present invention relates to a textile product such as raw fiber, yarn, fabric, and end product which bears one or more colors on its surface.

2. Description of the Related Art

Heretofore, the coloring of textile products has been only possible with dyes or pigments, and the coloring with dyes or pigments has a problem with it requiring many steps and a large amount of water.

With this in mind, the present inventors invented a method for coloring a textile product with a metal deposited on the fiber surface by sputtering. This method is very useful for the coloring of textile products because it is able to produce any color, especially metallic color. Unfortunately, most metals have achromatic colors and metal compounds are necessary where chromatic colors are desirable. To make matters worse, the sputtering of metal compounds is usually slow in film forming. This means that sputtering takes a longer time to form a deposit film thick enough to hide the color of the substrate fiber. This holds true of the case where titanium nitride is deposited to impart a bright golden color to the fiber. In this case the prolonged sputtering generates heat and changes of a surface of the titanium nitride that changes the composition of the titanium nitride, with the result that the deposited film takes on a reddish color rather than a desired golden color. In other words, the above-mentioned sputtering process has a very narrow latitude in optimum conditions.

SUMMARY OF THE INVENTION

It is an object of the present invention to provide a color-bearing textile product the color of which is not affected by the color of the fiber itself even in the case where the deposited metal layer or metal compound layer of chromatic color is thin.

It is another object of the present invention to provide a color-bearing textile product the desired color of which is produced under a broad range of sputtering conditions such as the pressure and the voltage applied.

It is another object of the present invention to provide a bright color-bearing textile product which can be produced easily in a short time.

It is another object of the present invention to provide a color-bearing textile product on the surface of which is firmly formed a metal layer or metal compound layer of chromatic color.

It is another object of the present invention to provide a process for producing easily a bright color-bearing textile product.

It is another object of the present invention to provide a process for producing a color-bearing textile product continuously without the need for exchanging the titanium target during sputtering.

For achieving the above described objects, the color-bearing textile product of the present invention comprises fibers, a silver-gray metal layer formed on the surface of said fibers by sputtering, and a metal layer or metal compound layer of chromatic color formed on the surface of said metal layer by sputtering.

Other and further objects of this invention will become obvious upon an understanding of the illustrative embodiments about to be described or will be indicated in the appended claims, and various advantages not referred to herein will occur to one skilled in the art upon employment of the invention in practice.

DETAILED DESCRIPTION OF THE PREFERRED EMBODIMENTS

The invention will be described in reference to FIGS. 1 to 4 showing an embodiment of the invention which is in the form of a fabric.

Figure 1:
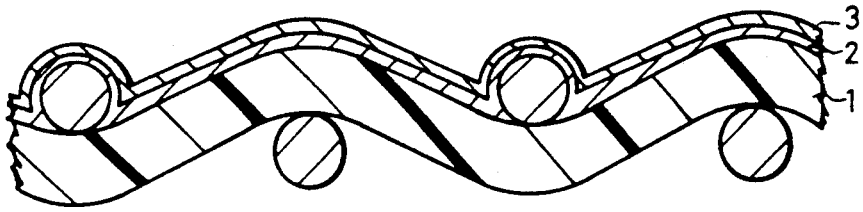
FIG. 1 is an enlarged sectional view of a fabric taken in the direction of the arrows along the line I—I of FIG. 2.
Figure 2:
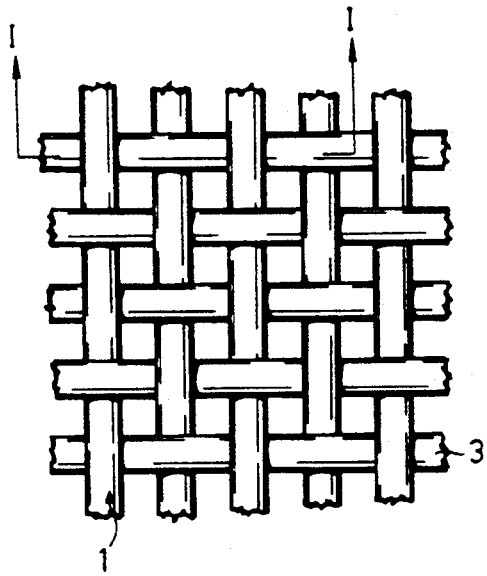
FIG. 2 is a plan view of a surface of a fabric embodying the invention.

The fabric 1 shown in FIGS. 1 and 2 is a plan weave fabric of synthetic fiber such as polyester fiber. On the surface of the fabric 1 is a silver-gray metal layer 2 which is deposited by sputtering. This silver-gray metal layer 2 hides the color of the fabric 1 on account of its high reflectivity for all the wavelengths of the light incident upon the surface thereof. In this embodiment, the metal layer 2 is formed of titanium.

On the surface of the metal layer 2 is a metal compound layer 3 of chromatic color which is formed also by sputtering. This metal compound layer 3 is formed of titanium nitride (TiN) which has a golden color.

Thus the fabric 1 coated with the two layers 2 and 3 does not reveal the color of the fabric 1 itself but takes on a bright golden color because the light incident upon the fabric is effectively reflected by the silver-gray metal layer 2 through the metal compound layer 3.

Figure 3:
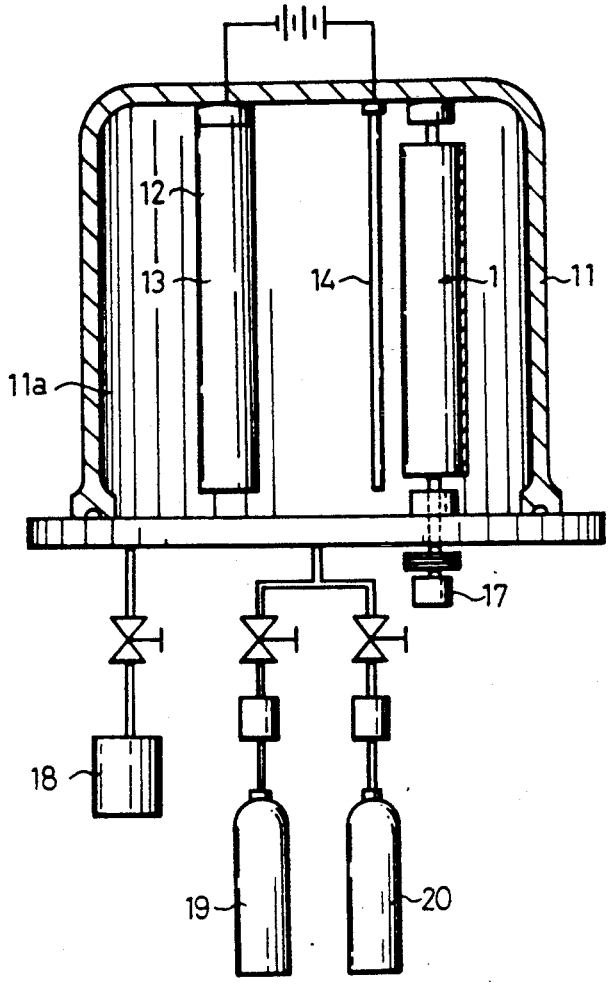
FIG. 3 is a sectional view of a sputtering apparatus.
Figure 4:
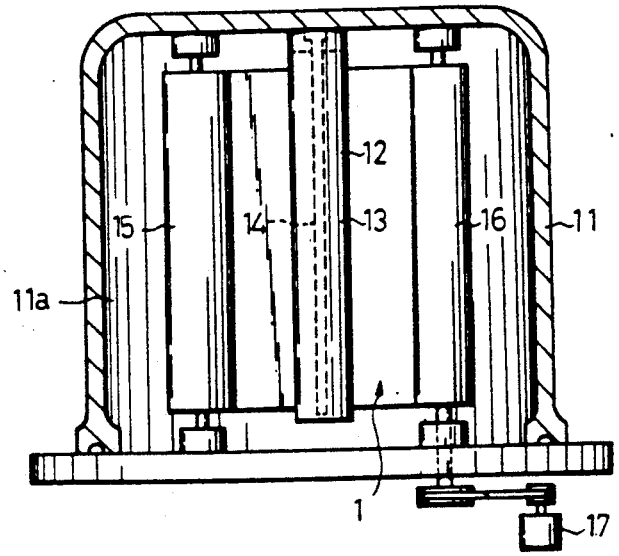
FIG. 4 is another sectional view of the same sputtering apparatus as shown in FIG. 3.

The fabric 1 constructed as mentioned above is produced by using a vertical low-temperature, high-rate sputtering apparatus as shown in FIGS. 3 and 4. This apparatus is designed to wind the web in a vertical manner. This apparatus has a vacuum chamber 11 in which sputtering is performed. To the inner top of the vacuum chamber 11 is attached a cylindrical cathode 12 having, at least on a surface thereof, a target 13 formed from a metal (titanium) to be deposited on the fabric 1. To the inner top of the vacuum chamber 11 is also attached a round rod-like anode 14. The cathode 12 and the anode 14 face to each other at a certain distance, and a DC voltage of 550 V (maximum) is applied across them. On the opposite side of the anode 14 with respect to the cathode 12 are a pair of rolls 15 and 16. The roll 16 is driven by a drive unit 17 so that the fabric 1 is wound in both directions between the rolls 15 and 16. The vacuum chamber 11 is connected to a vacuum pump 18 to evacuate an interior 11*a* of the vacuum chamber 11 and an argon supply unit 19 and a nitrogen supply unit 20 to introduce argon and nitrogen, respectively, into the interior 11*a*.

To perform sputtering using this apparatus, the interior 11*a* of the vacuum chamber 11 is evacuated to the order of $10^{-5}$ Torr by the vacuum pump 18. And the argon supply unit 19 is actuated to supply argon to the interior 11*a* so as to form the atmosphere of argon at $3\text{–}9\times10^{-4}$ Torr. A DC voltage of 400–500 V (100–120

A) is applied across the anode 14 and the cathode 12 provided with the target 13.

The voltage application generates argon ions which eject titanium particles from the surface of the target 13, and the ejected titanium particles deposit on the surface of the fabric 1. During the voltage application, the fabric 1 is fed from the roll 15 to the roll 16 at a rate of 1 to 1.5 m/min by the drive unit 17. Thus the surface of the fabric 1 is coated with the silver-gray titanium layer 2.

When the fabric 1 is entirely coated with the sliver-gray titanium layer 2, the argon supply unit 19 is shut down, with the vacuum pump 18 running, thereby to evacuated the interior 11*a* of the vacuum chamber 11 to $10^{-5}$ Torr. Then, the nitrogen supply unit 20 is actuated so that a low-temperature mixed-gas atmosphere at $3\text{-}6\times10^{-4}$ Torr is formed in the vacuum chamber 11. The argon supply unit 19 is started again so that the pressure of the interior 11*a* is raised to $6\text{-}9\times10^{-4}$ Torr. A DC voltage of 400–550 V (100–120 A) is applied across the two electrodes 12 and 14.

The voltage application generates argon ions which eject titanium particles from the surface of the target 13 as mentioned above. This time, the ejected titanium particles immediately react with nitrogen to form titanium nitride (TiN) because the vacuum chamber 11 contains nitrogen gas and highly active nitrogen ions dissociated from the nitrogen gas. During the voltage application, the fabric 1 is moved backward from the roll 16 to the roll 15 at a rate of 0.8 to 1.2 m/min. Thus the surface of the silver-gray titanium layer 2 on the fabric 1 is coated with the golden titanium nitride layer 3.

In the case where titanium nitride alone is deposited on the fabric 1 to produce a bright golden color, it is necessary to perform sputtering in a delicate condition as mentioned below. At first, the interior 11*a* of the vacuum chamber 11 is evacuated to the order of $10^{-5}$ Torr by the vacuum pump 18. Then the nitrogen supply unit 20 is actuated to raise the pressure in the vacuum chamber 11 to $1\times10^{-4}$ Torr, and further the argon supply unit 19 is actuated to raise the pressure in the vacuum chamber 11 to $5\times10^{-4}$ Torr. A DC voltage of 350 V (30 A) is applied across the two electrodes 12 and 14. During the voltage application, the fabric 1 is wound up at a rate of 0.3 to 0.4 m/min by the drive unit 17. Thus, the fabric 1 is coated with only the titanium nitride layer 3.

A disadvantage of this single-step process is that the color of the deposited titanium nitride layer 3 varies depending on the operating conditions. For example, if the voltage is higher than 350 V, the titanium nitride layer 3 takes on a reddish color rather than a bright golden color. On the other hand, if the winding speed for the fabric 1 is higher than 0.3 to 0.4 m/min, the titanium nitride layer 3 is too thin to produce a bright golden color. With the winding speed lower than 0.3 to 0.4 m/min, the titanium nitride layer 3 takes on a reddish color.

That is, the disadvantage of the single-step process is that even a slight fluctuation in sputtering conditions changes the composition of titanium nitride, causing the resulting titanium nitride layer to assume a reddish color instead of a golden color. On the other hand, if the titanium nitride is deposited in thick layer to hide the color of the fabric 1, the sputtering operation takes a long time and tends to fluctuate in operating conditions. Therefore, it is difficult to impart a bright golden color to the surface of the fabric 1 with the single titanium nitride layer.

In the embodiment of the invention, the surface to the fabric 1 is coated with the silver-gray titanium layer 2 which hides the color of the fabric 1 and reflects the light incident upon the fabric 1, and the silver-gray titanium layer 2 is further coated with the thin titanium nitride layer 3 assuming a golden color. The reflected light takes on a golden color when passing through the thin titanium nitride layer 3. Being thin, the titanium nitride layer 3 produces a uniform color regardless of slight fluctuation in thickness. This means that the titanium nitride layer 3 can be formed under less stringent sputtering conditions, so it is especially preferable to embody this invention using titanium nitride.

An advantage of the embodiment is that the metal to form the metal layer 2 is titanium and the metal compound to form the metal compound layer 3 of chromatic color is titanium nitride; therefore, it is possible to form the two layers 2 and 3 without having to replace the titanium target 13, and to perform the sputtering operation continuously without breaking the vacuum of the chamber 11. The continuous operation saves time for sputtering.

According to the present invention, the metal layer or metal compound layer of chromatic color can be made thin, as mentioned above. This feature is advantageous particularly in the case where gold or other precious metal is used for the metal layer of chromatic color. This contributes to the saving of production cost.

The fabric 1 retains the layers 2 and 3 coated thereon even when it is washed or rubbed, because the layers formed by sputtering firmly adheres to the fabric 1. In sputtering, particles impinge against the fabric 1 with energy about 1000 times that in vacuum deposition.

The process of the invention has the advantage ascribed to the sputtering process. That is, it permits the use of high-melt, corrosion-resistant pure metals or alloys as well as low-melt metals, while vacuum deposition only permits the use of the low-melt metals.

The present invention is not limited to the embodiment mentioned above. The following modification would be possible.

(1) The silver-gray metal layer 2 may be formed of alloy such as Hastelloy other than titanium. Namely, any metal or alloy which takes on a silver gray color may be used.

(2) The metal layer or metal compound layer of chromatic color may be formed of gold, silver, copper, or brass.

(3) The substrate for coating may be raw fiber, yarn, end products, or intermediate products. The fabric 1 may include not only woven, knitted, and non-woven fabrics but also raised and flocked fabrics.

As many apparently widely different embodiments of this invention may be made without departing from the spirit and scope thereof, it is to be understood that the invention is not limited to the specific embodiments thereof except as defined in the appended claims.

What is claimed is:

1. A process for producing a color-bearing textile product comprising the following sequential steps performed without opening a closed chamber:

evacuating the interior of the closed chamber which contains a textile product and a target made of titanium;

introducing a nitrogen-free inactive gas into the chamber;

sputtering the target in an atmosphere of the inactive gas to form a titanium layer on the surface of the textile product;

introducing nitrogen gas into the chamber; and sputtering the target in an atmosphere of both the inactive gas and nitrogen to form a titanium nitride layer on the titanium layer.

2. A process for producing a color-bearing textile product as claimed in claim 1, wherein the titanium nitride layer has such a thickness as permits light to pass therethrough.

3. A process for producing a color-bearing textile product as claimed in claim 2, wherein the inactive gas is argon.

4. A process for producing a color-bearing textile product as claimed in claim 3, wherein the pressure in the chamber is reduced to the order of $10^{-5}$ Torr during the evacuating step, is pressurized to in the range of $3\text{-}9\times10^{-4}$ Torr during the inactive gas introducing step, and is pressurized to in the range of $6\text{-}9\times10^{-4}$ Torr during the nitrogen introducing step.

5. A process for producing a color-bearing textile product as claimed in claim 3, wherein an applied voltage on sputtering is in the range of 400 to 550 V.

6. A process for producing a color-bearing textile product comprising the following sequential steps performed without opening a closed chamber;

evacuating the interior of the closed chamber which contains a textile product and a target made of titanium, the pressure in the chamber being reduced to the order of $10^{-5}$ Torr;

introducing argon gas into the chamber, and pressurizing the chamber to in the range of $3\text{-}9\times10^{-4}$ Torr;

sputtering the target in an argon atmosphere with an applied voltage in the range of 400 to 550 V to form a titanium layer on the surface of the textile product;

introducing nitrogen gas into the chamber, and pressurizing the chamber to in the range of $6\text{-}9\times10^{-4}$ Torr; and sputtering the target in a mixed atmosphere of argon and nitrogen with an applied voltage in the range of 400 to 550 V to form a titanium nitride layer on the titanium layer, the titanium nitride layer having such a thickness as permits light to pass therethrough.

* * * * *